US005934956A

United States Patent [19]

Michel et al.

[11] Patent Number: 5,934,956

[45] Date of Patent: Aug. 10, 1999

[54] MOUNTING ARRANGEMENT FOR ENGINE STEERING CYLINDER

[76] Inventors: William Michel; Steve Brady; Mike Kostic, all of 26 S. Dawson St., Seattle, Wash.; John Janowiecki, 325 Carr Dr., Brookville, Ohio

[21] Appl. No.: 09/073,218

[22] Filed: May 6, 1998

[51] Int. Cl.[6] ..... B63H 5/125

[52] U.S. Cl. ..... 440/61; 114/150

[58] Field of Search ..... 440/61, 53, 63, 440/59, 65, 900; 114/150; 248/640–643

[56] References Cited

U.S. PATENT DOCUMENTS

| | | | |
|---|---|---|---|
| 5,542,864 | 8/1996 | Peebles | 114/150 |
| 5,601,463 | 2/1997 | Kobelt | 114/150 |
| 5,643,022 | 7/1997 | Wagner | 440/61 |
| 5,658,177 | 8/1997 | Wagner | 440/61 |

*Primary Examiner*—Stephen Avila

[57] ABSTRACT

A steering cylinder mounting assembly includes a cylinder housing having a longitudinal opening formed therethrough, a groove formed along a longitudinal face of the cylinder housing, a protruding rib formed at opposite longitudinal ends of the cylinder housing and formed spaced apart from and parallel to the groove, and a plurality of apertures formed in a surface of the cylinder housing opposing the groove and transverse to a longitudinal axis of the cylinder housing. A mounting bracket is selectively connected with the cylinder housing and positioned between the protruding ribs. The mounting bracket includes a tongue portion engageable with the groove of the cylinder housing, and a plurality of apertures formed therein transverse to a longitudinal axis of the cylinder housing. Connecting members are aligned with the apertures of the cylinder housing and the mounting bracket for securing the cylinder housing to the mounting bracket. A cylinder rod is rotatably mounted within the longitudinal opening of the cylinder housing. The cylinder rod includes a main body portion and opposing terminal end portions, each opposing terminal end portion having a reduced diameter relative to the diameter of the cylinder rod and an asymmetrical tapered portion connecting the terminal end and the main body portion of the cylinder rod. The asymmetrical tapered portion positions a longitudinal axis of the terminal end portions to be offset from a longitudinal axis of said cylinder rod.

25 Claims, 6 Drawing Sheets

MOUNTING ARRANGEMENT FOR ENGINE STEERING CYLINDER

BACKGROUND OF THE INVENTION

1. Field of the Invention

The present invention relates to a mounting arrangement for an engine steering cylinder for use in a variety of engines known in the art.

2. Description of Related Art

Known mounting arrangements for an engine steering cylinder include a mounting bracket used to couple a hydraulic steering cylinder to multiple brands of outboard engines. The bracket has first and second groups of holes, the holes of each group positionally corresponding to a bracket attachment hole in a particular brand of engine. The cylinder is generally machined to complement the bracket. The bracket additionally includes at least one cutout area on an upper or lower edge thereof for fitting the bracket around a Zerk fitting on a particular brand of engine. In operation, the mounting bracket must at times be inverted to accommodate certain types of engines. A piston rod is fit within the cylinder and essentially remains in its installed orientation with respect to the cylinder. Steering linkage extends between the engine tiller bar and the end of the piston rod. At least a portion of the steering linkage is invertible and must be manipulated so that an attachment portion thereof is upward or downward according to an engine type.

A problem exists, however, in that installation of the described conventional bracket and cylinder requires that the installer install the bracket to the engine, then hold the cylinder precisely in place while aligning and installing the cylinder to bracket mounting bolts. This is complicated and difficult due to the placement of the cylinder to bracket mounting holes and the fact that the bend in the mounting bracket that contains the holes of the mounting bolts is rarely perfect and therefore often required manipulation of the cylinder for attachment. Additionally, the placement of the cylinder to bracket mounting bolts makes tightening them with a wrench or socket difficult. The installer runs the risk of scratching the cylinder shaft with the wrench when tightening these bolts.

Accordingly, while the conventional mounting arrangements were suitable for their intended purpose, the need for simplification in mounting and a more universal design necessitated the development of a mounting arrangement for an engine steering cylinder which allows installation labor savings particularly in the connection of the bracket to the cylinder over known designs.

SUMMARY OF THE INVENTION

It is therefor an object of the present invention to provide an arrangement for mounting an engine steering cylinder which overcomes the problems of the art identified above.

More particularly, it is an object of the invention to provide an arrangement for mounting an engine steering cylinder which enables easy connection of a bracket to a cylinder.

Still further, it is an object of the invention to provide an arrangement for mounting an engine steering cylinder which allows for installation of cylinder mounting bolts and related hardware subsequent to an initial tongue and groove connection between the cylinder and the bracket.

Even further, it is an object of the invention to provide an arrangement for mounting an engine steering cylinder which adjusts a height of the linkage assembly by rotating a piston rod within the steering cylinder housing.

Additionally, it is an object of the invention to provide an arrangement for mounting an engine steering cylinder in which at least one end of the steering cylinder piston rod is machined to terminate in an asymmetrical reduced diameter end offset from a longitudinal axis of the piston rod.

In achieving the objects of the present invention, there is provided a steering cylinder mounting assembly including a steering cylinder housing. The steering cylinder housing includes an upper surface, a lower surface, an outer face, an inner face having a protruding surface coextensive with an upper surface of the housing and terminating in a lip edge, a groove formed parallel to and inwardly of the lip edge, at least one rib member formed above and spaced apart from the lip edge and groove combination, and a lower surface spaced apart from and parallel to the at least one rib member. A longitudinal opening is formed through the cylinder housing and a cylinder rod is rotatably mounted within the longitudinal opening of the cylinder housing. The cylinder rod includes a main body portion and opposing end portions, each opposing end portion having a reduced diameter terminal end. An asymmetrical taper connects the terminal end and the main body portion. The asymmetrical taper is formed so that a longitudinal axis of the reduced diameter terminal end is offset from a longitudinal axis of the cylinder rod. A mounting bracket is selectively engageable with the cylinder housing. The mounting bracket includes a rear planar face, an upper stepped edge, and a lower edge, the upper stepped edge including a tongue portion insertable into the groove of the cylinder housing, and securing members for securing the mounting bracket to the cylinder housing. A link arm is provided having a first end removably connected to the terminal end of the cylinder rod and a second end opposite the first end. A clevis is connected to the link arm at the end opposite the first end. Rotation of the cylinder rod within said cylinder housing adjusts a height of the clevis with respect to the mounting bracket, thereby enabling connection of the steering cylinder assembly to a plurality of engine types.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
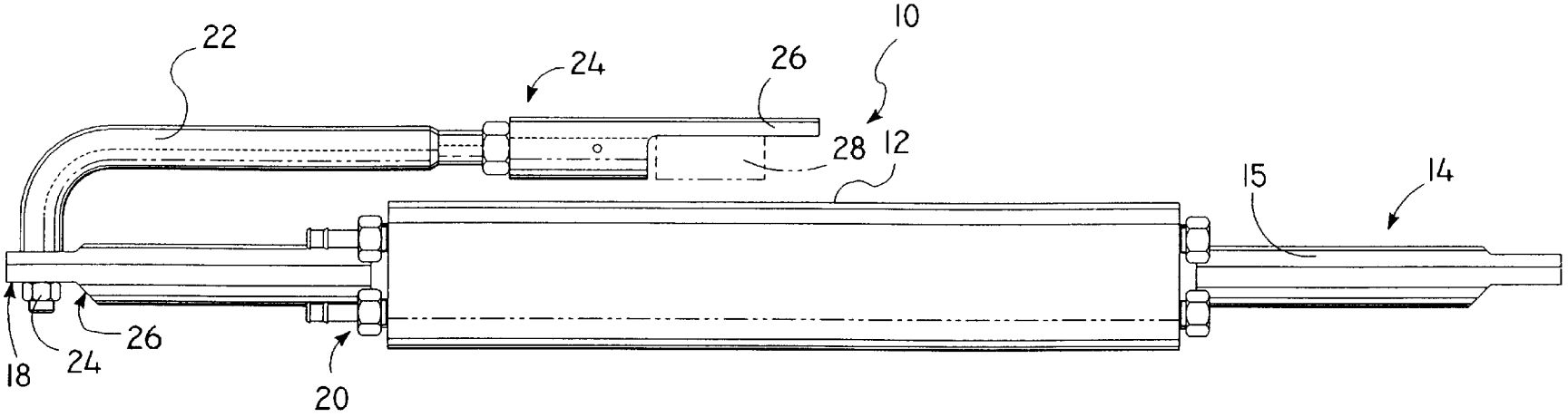
FIG. 1 is a front view of steering cylinder assembly according to a preferred embodiment of the present invention.

Referring first to FIG. 1, there is shown a steering cylinder assembly 10 according to a preferred embodiment of the present invention. In particular, the steering cylinder assembly 10 includes a cylinder housing 12 having a piston rod 14 formed therethrough. The cylinder housing 12 is of the type in which the cylinder rod 14 extends from opposite ends thereof, and the piston rod 14 is rotatable within the cylinder housing 12.

The cylinder rod 14 includes a primary body portion 15 having a substantially cylindrical shape. The body portion 15 of the cylinder rod 14 is that which extends through the cylinder housing 12. Opposite ends of the cylinder rod 14 extend beyond the interior of the cylinder housing 12 and include a tapered transition portion 16 and a reduced diameter terminal end 18 beyond the tapered transition portion 16. It should be noted that the tapered transition 16 is asymmetrical such that a longitudinal axis of the reduced diameter terminal end 18 is offset from a longitudinal axis of the cylinder rod 14. The terminal end 18 of the cylinder rod 14 is both of a smaller diameter and axially offset from the longitudinal axis of the main body portion 15 of the cylinder rod 14. The purpose of this arrangement is to enable the steering cylinder assembly to be used with a variety of engine types, with minimal mounting effort.

Figure 3:
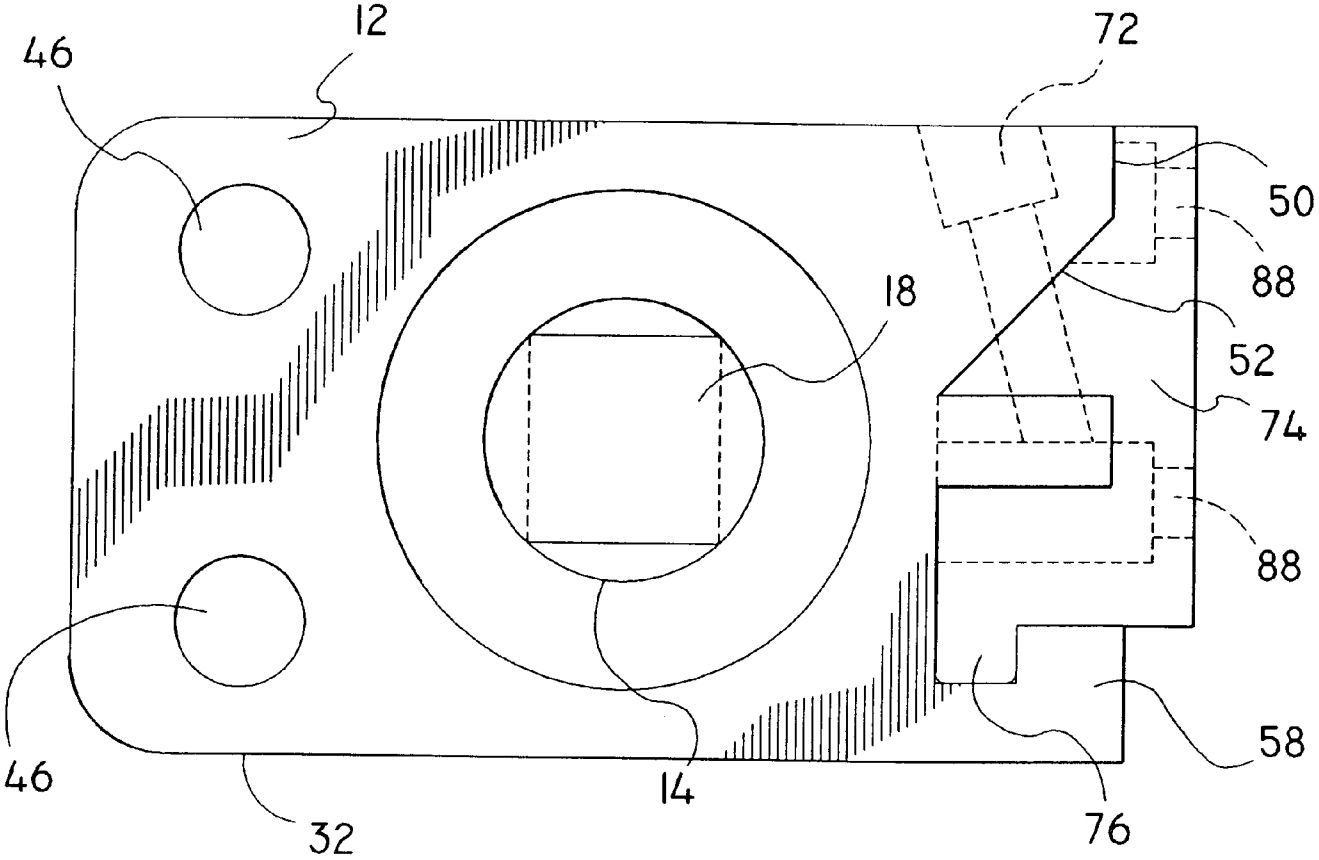
FIG. 3 is an end view of a steering cylinder in combination with an engine mounting bracket.

Further, as shown in FIG. 3, the terminal end 18 of the cylinder rod 14 is machined to be preferably angular in shape. The options of the angular shape would include a triangle, a square, or a rectangle as actually shown in the figure. The importance of the shape of the terminal end 18 will become apparent in the following.

The steering cylinder assembly 10 additionally includes a link arm 22 connected to the reduced diameter terminal end 18 of the cylinder rod 14. The link arm 22 is somewhat L-shaped and is connected at a first end thereof to the cylinder rod 14 by connections 24 and terminates at the opposite end thereof in a selectively removable clevis 26.

The connections 24 of the first end of the link arm 22 are such that they will easily engage with the terminal end 18 of the cylinder rod. Because of the angular shape of the terminal end of the cylinder rod 14, a "face" is presented to the connections 24 of the link arm for easy connection thereto. Any suitable type of connections 24 may be used, for example welding, a threaded bolt connection, or the like.

The clevis 26 is substantially uniform in shape and outer diameter to the link arm 22 with the exception of an asymmetrical clevis extension 28. The clevis 26 is threadably connected to the link arm 22 and may be oriented thereon in virtually any direction within 360 degrees. The clevis extension 28 is of a reduced diameter with respect to the body of the clevis 26 and includes flat surface engaging portions 28*a* and 28*b* on two sides thereof. The surface engaging portions engage with a tiller 30 in a manner to be explained in connection with the mounting of selected engine types shown in FIGS. 4, 5, and 6.

Figure 2:
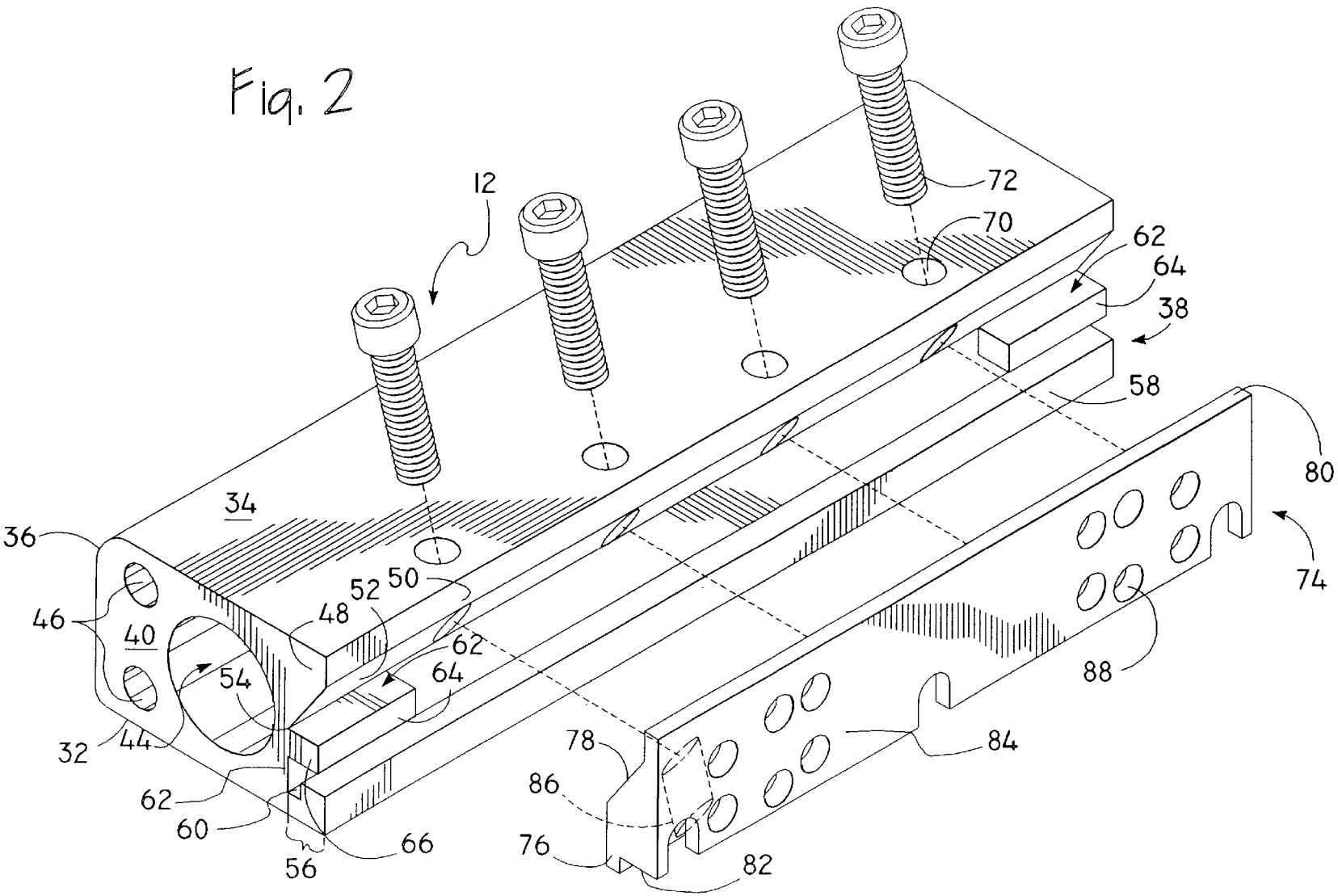
FIG. 2 is an exploded rear perspective view of the steering cylinder of FIG. 1 in combination with an engine mounting bracket.

Turning now to FIG. 2, there is shown a rear perspective view of an inverted steering cylinder housing 12 absent the cylinder rod 14 in order to illustrate the connection of the steering cylinder housing 12 to a mounting bracket and engine. The steering cylinder housing 12 includes an upper surface 32, a lower surface 34, a front face 36, a rear face 38, and opposite longitudinal ends 40, 42. Each end 40, 42 of the cylinder housing 12 includes a central longitudinal opening formed therein for receipt of the cylinder rod 14, and at least a pair of openings 46 to receive fittings for the exchange of hydraulic fluid within the cylinder housing 12. The upper 32 and lower 34 surfaces of the cylinder housing 12 are intended to be substantially planar for simplicity and ease of construction. The front face 36 of the cylinder housing 12 is shown as generally curved, however, this feature is not critical to the invention and may be of any suitable, easily manufactured shape. On the rear face 38 of the cylinder housing 12, however, there is a unique configuration. In particular, the rear face 38 of the cylinder housing 12 includes a lower projection 48 coextensive with the lower surface 34 of the cylinder housing 12. The projection 48 is achieved by cutting out the cylinder housing 12 toward an interior thereof. The projection 48 is formed so as to have a vertically planed edge 50, and is then angled downward to form an inner angled face 52 (more easily seen in FIG. 3). The inner angled face 52 terminates interior of the cylinder housing 12 at 54. An upper tongue and groove portion 56 extends substantially an entire length of and is coextensive with the upper surface 32 of the cylinder housing 12 such that a tongue portion 58 of the tongue and groove 56 is the terminal edge of the upper surface 32 of the cylinder housing 12 and a groove 60 is parallel to and interior of the tongue portion 58. An inner longitudinal face 62 of the groove portion 60 of the tongue and groove 56 is vertically aligned with the inner termination 54 of the angled face 52 of the lower projection 48. In addition, a pair of ribs 62 are positioned so as to be vertically interposed between the lower projection 48 and the upper tongue and groove portion 56 of the cylinder housing 12 as shown. Each rib 62 is integrally formed with the cylinder housing 12 and is positioned adjacent the inner termination 54 of the angled face 52 of the lower projection 48. An outer end 66 of each rib 62 is coplanar with each opposite end 40, 42 of the cylinder housing 12 and projects from an interior of the cylinder housing 12 so as to be parallel to both the lower projection 48 and the upper tongue and groove portion 56. An inner end 68 of each rib 62 terminates at a predetermined distance in from the opposite ends 40, 42 of the cylinder housing 12. A face 64 of each rib defines the rear portion of the rib 62 and is in surface contact with a portion of a mounting bracket 74 (detailed below) upon engagement of the cylinder housing 12 with the mounting bracket 74. The selection of the length of each rib 62 will be discussed more fully in connection with the mounting of the cylinder housing 12 to the mounting bracket 74 in the following.

The cylinder housing 12 additionally includes a plurality of openings 70 formed in the lower surface 34 thereof. The plurality of openings 70 are positioned adjacent the vertically planed edge 50 of the lower surface 34 of the housing 12 for receiving a corresponding plurality of mounting bolts 72 therein. As shown in FIG. 2, one option is to have the plurality of mounting bolts 72 be of the type that will recess into the corresponding openings 70 so as to achieve a smooth planar lower surface 34.

Referring still to FIG. 2, the cylinder housing 12 is fixed to any one of a plurality of engine types by the use of the mounting bracket 74. The mounting bracket 74 is also of a unique shape so as to conformally engage with the features described in connection with the cylinder housing 12. In particular, the mounting bracket 74 includes an upper groove engaging portion 76 for engagement with the groove 60 of the cylinder housing 12, a slanted inner face 78 for mating with the inner angled face 52 of the cylinder housing 12, a lower extension 80 for mating with the vertically planed edge 50 of the cylinder housing 12, a tongue engaging surface 82, and an external face 84 opposing the slanted inner face 78.

The slanted inner face 78 of the mounting bracket 74 includes a plurality of apertures 86 formed therein. The plurality of apertures 86 align with the plurality of apertures 70 on the lower face 34 of the cylinder housing 12. Upon insertion of the mounting bolt 72 into one of the openings 70, the mounting bolt 72 likewise engages with a corresponding aperture 86 of the mounting bracket 74, thereby securing the cylinder housing 12 to the mounting bracket 74. The plurality of apertures 70 are slightly angled to align with correspondingly angled apertures 86 in the mounting bracket 74. Additionally, the mounting bolts 72 may be inserted perpendicular to the planar bottom surface of the cylinder housing 12 (not shown). The angle of insertion of the mounting bolts 72, therefore, may be anywhere from perpendicular to a planar surface of the cylinder housing to an angle up to approximately 45 degrees away from perpendicular. As shown, the angle is directed away from a rear of the cylinder housing 12. Although the use of four mounting bolts 72 are shown, any suitable number of mounting bolts may be used.

The mounting bracket 74 additionally includes a plurality of apertures 88 formed in the external face 84 thereof. The particular arrangement of apertures 88 corresponds to arrangements known in the art by which the mounting bracket 74 is mounted to a particular engine (not shown).

FIG. 3 is a side view of the combined mounting bracket 74 and cylinder 12. In particular, FIG. 3 best illustrates the manner in which the tongue and groove assembly is completed. The upper groove engaging portion 76 of the mounting bracket 74 is seated in the groove 60 of the cylinder housing 12. As shown, the groove engaging portion 76 is in substantially a surface to surface contact with an entirety of the groove 60. It should be understood that the formation of the groove engaging portion 76 may terminate in either an arcuate surface or a rectangular surface and the groove 60 may likewise be either an arcuate surface or a rectangular surface as long as each is substantially conforming with the other. Further, the tongue engaging surface 82 of the mounting bracket 74 seats on the upper surface of the tongue 58 of the cylinder housing 12.

Because of the arrangement described, the bracket 74 and cylinder housing 12 mounting provides for a completely integrated assembly of the bracket 74 and cylinder housing 12. All four sides of the bracket 74 are used to make an integrated connection between these two parts. The tongue and groove on the top of the cylinder housing 12 provides for complete linear connection across the top of the cylinder housing 12 and bracket 74, the sides of the bracket 74 make contact with the ribs 62 on both sides of the cylinder housing 12 to counter side loading forces, and the bottom 34 of the cylinder housing 12 is connected to the bracket with four bolts 74 which completes all four sides of connection. In essence, the cylinder housing 12 and bracket 74 become one. As an added benefit, the cylinder body 12 covers over recessed bolt heads (not shown) that are used to mount the bracket 74 to the engine (not shown). This prevents the bolts from vibrating out and the cylinder housing 12 and bracket 74 from falling off the front of the engine.

Figure 4:
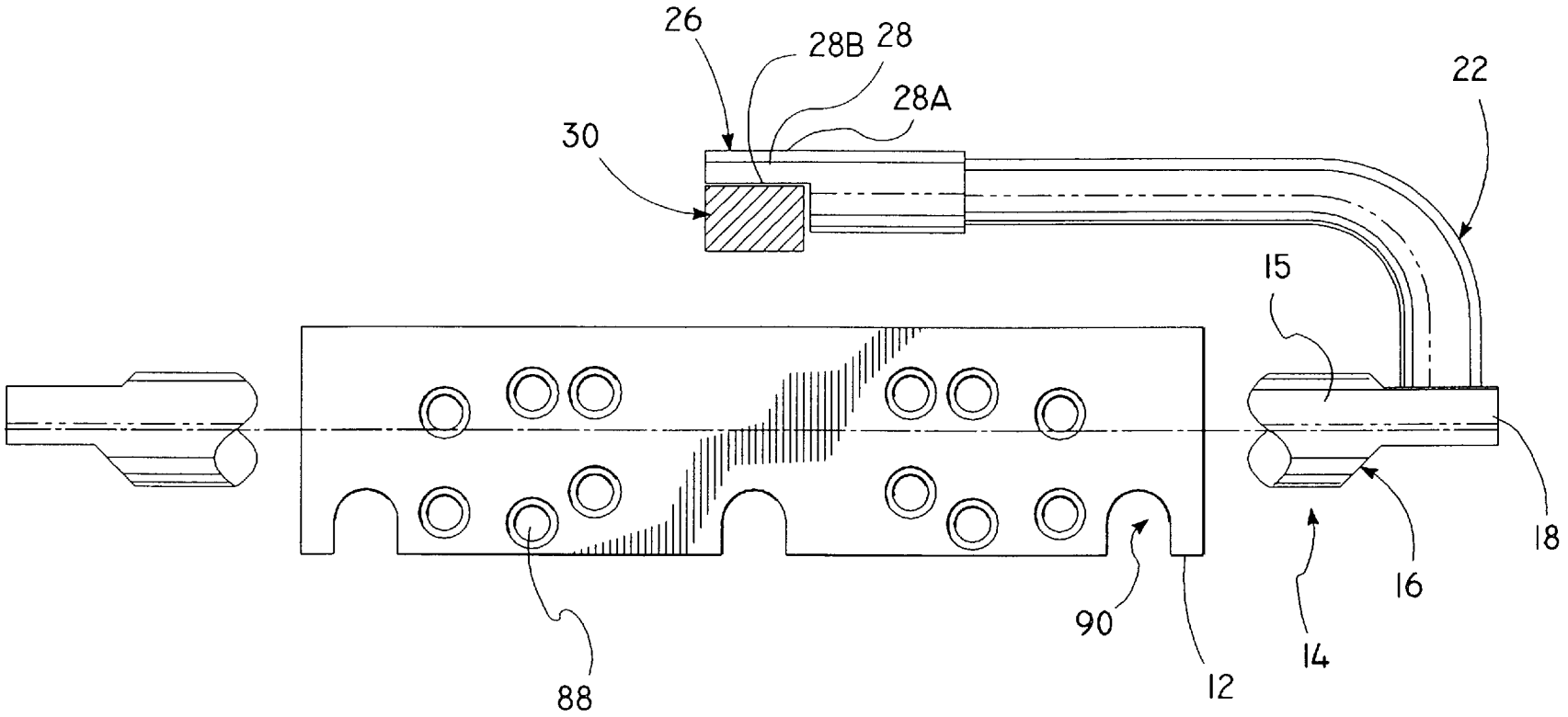
FIG. 4 is a rear view of the steering cylinder assembly adapted to a first type of engine.
Figure 5:
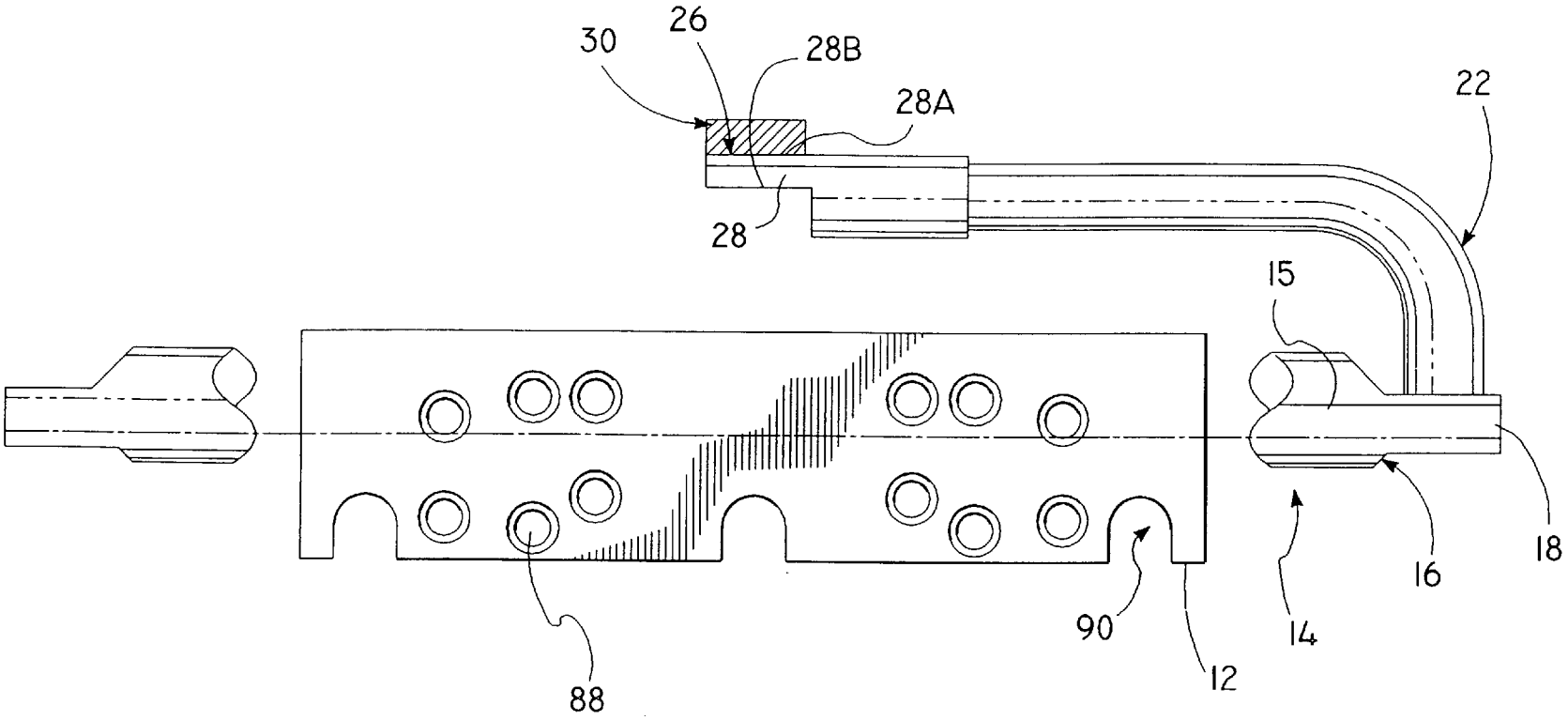
FIG. 5 is a rear view of the steering cylinder assembly adapted to a second type of engine.
Figure 6:
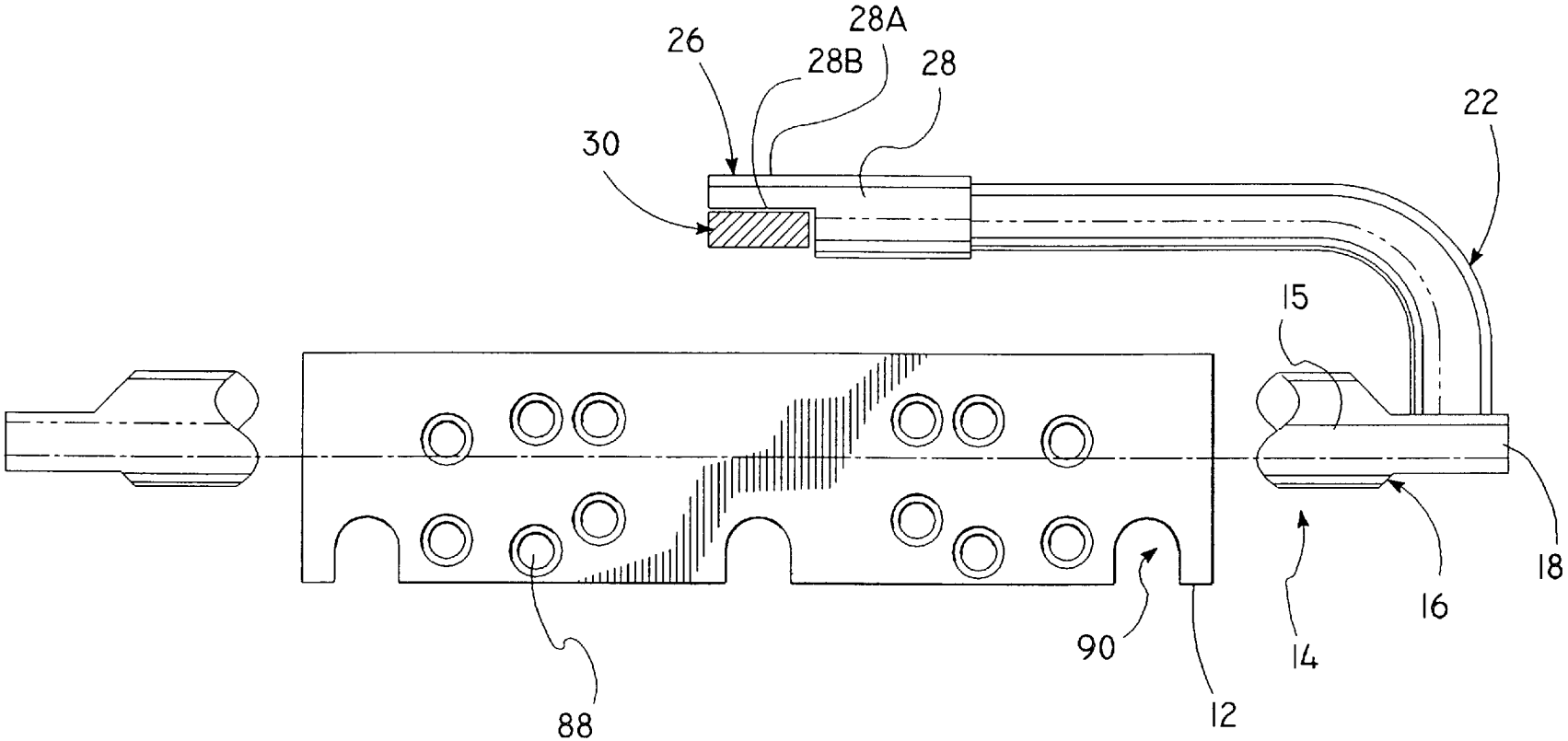
FIG. 6 is a rear view of the steering cylinder assembly adapted to a third type of engine.

When viewing the mounting bracket in FIGS. 4, 5 and 6, additional features are shown which are considered to be conventional. Specifically, in order to easily fit the mounting bracket 74 onto all types of engines, a plurality of, for example three, three fitting cutouts 90 are provided on one edge thereof for avoiding Zerk fitting on certain brands fo engines. The cutouts 90 are shown to be semicircular in shape, but may be of any shape to enable a flush mounting of the bracket 74 against an engine without interference from Zerk fittings. In distinction from known types of mounting arrangements, the cutouts 90 are only formed in one edge of the mounting bracket 74. The reason for the formation of cutouts 90 in only one edge of the mounting bracket 74 is that the mounting bracket does not need to be inverted at any time. It is always used in the same orientation. Accordingly, the Zerk fitting cutouts 90 shown in FIGS. 4, 5 and 6 and are formed in only one edge of the mounting bracket 74.

Turning now to the unique mounting arrangement of the steering cylinder assembly 10 to various engines, the universal applicability thereof will become apparent. Each of FIGS. 4, 5, and 6 illustrate the mounting of the steering cylinder assembly 10 to at least one of a plurality of known engines. FIG. 4 illustrates connection to any one of a Mercury, Honda, or Force engine. In FIG. 4, the cylinder rod is rotated such that the longitudinal axis of the terminal end portion is higher than the longitudinal axis of the cylinder rod 14. By this arrangement, the link arm 22 is connected at its highest elevation with respect to the tiller 30. In doing so, the lower engaging surface 28*b* of the clevis extension 28 is in engagement with the tiller 30. Because of the mobility of the cylinder rod 14, and the shape of the tapered transition portion 16 of the cylinder rod 14, the height of the link arm 22 and thus the clevis 26 of the link arm 22 is easily matched to the Mercury, Honda, and Force engines. Note that it is not necessary to invert the mounting bracket 74 as is known in the art. Instead, a single universal mounting bracket 74 is engageable in the same manner with the cylinder housing 12 regardless of an engine type. Further, the adjustment of the cylinder rod 14 to orient the reduced diameter terminal end and the connection of the link arm 22 to the cylinder rod 14 and the subsequent mounting of the cylinder 12 with the mounting bracket 74 may therefore be done by an individual.

Similarly, FIG. 5 illustrates connection to either one of a Suzuki or Yamaha engine. In FIG. 5, the cylinder rod 14 is oriented such that a longitudinal axis of the terminal end portion 18 is lower than the longitudinal axis of the cylinder rod 14. By this arrangement, the link arm 22 is connected at its lowest elevation with respect to the tiller 30. In doing so, the upper engaging surface 28*a* of the clevis extension 28 is in engagement with the tiller 30. Because of the mobility of the cylinder rod 14, and the shape of the tapered transition portion 16 of the cylinder rod 14, the height of the link arm 22 is easily adapted to the Suzuki and Yamaha engines, and therefore the clevis 26 of the link arm 22 is also easily matched to the Suzuki and Yamaha engines. Note once again that it is not necessary to invert the mounting bracket as is known in the art. Instead, a single universal mounting bracket 74 is engageable in the same manner with the cylinder housing 12 regardless of an engine type. Further, the adjustment of the cylinder rod 14 to orient the reduced diameter terminal end and the connection of the link arm 22 to the cylinder rod and the subsequent mounting of the cylinder housing 12 with the mounting bracket 74 may therefore be done by an individual.

Likewise, FIG. 6 illustrates connection to an OMC engine. In FIG. 6, the cylinder rod 14 is rotated such that the longitudinal axis of the terminal end portion 18 is lower than the longitudinal axis of the cylinder rod 14. By this arrangement, the link arm 22 is connected at its lowest elevation with respect to the tiller 30. In doing so, the lower engaging surface 28*b* of the clevis extension 28 is in engagement with the tiller 30. Because of the mobility of the cylinder rod 14, and the shape of the tapered transition portion 16 of the cylinder rod 14, the height of the link arm 22 is easily adapted to the OMC engine, and therefore the clevis 26 of the link arm 22 is easily matched to the OMC engine. Note once again that it is not necessary to adjust or potentially invert the mounting bracket as was previously known in the art. Instead, a single universal mounting bracket 74 is engageable in the same manner with the cylinder housing 12 regardless of an engine type. Further, the adjustment of the cylinder rod to orient the reduced diameter terminal end and the connection of the link arm 22 to the cylinder rod and the subsequent mounting of the cylinder with the mounting bracket 74 may be done by an individual.

By the assembly shown and described, the present invention achieves a steering cylinder mounting assembly which is universally applicable in the industry.

Such a universally adaptable steering cylinder mounting assembly has not previously been known in the art.

The invention being thus described, it will be obvious that the same may be varied in many ways. Such variations are not to be regarded as a departure from the spirit and scope of the invention, and all such modifications as would be apparent to one skilled in the art are intended to be included within the scope of the following claims.

I claim:

1. A steering cylinder mounting assembly comprising:

a cylinder housing having a longitudinal opening formed therethrough, a groove formed along a longitudinal face of the cylinder housing, a protruding rib formed at opposite longitudinal ends of said cylinder housing and formed spaced apart from and parallel to the groove, and a plurality of apertures formed in a surface of said cylinder housing opposing the groove and transverse to a longitudinal axis of said cylinder housing;

a mounting bracket selectively connected with said cylinder housing, said mounting bracket positioned between said protruding ribs and including a tongue portion engageable with the groove of said cylinder housing, and a plurality of apertures formed therein transverse to a longitudinal axis of said cylinder housing; and connecting members aligned with the apertures of said cylinder housing and said mounting bracket for securing said cylinder housing to said mounting bracket.

2. The steering cylinder mounting assembly according to claim 1, further comprising:

a cylinder rod rotatably mounted within the longitudinal opening of said cylinder housing, said cylinder rod including a main body portion and opposing terminal end portions, each opposing terminal end portion having a reduced diameter relative to said cylinder rod and an asymmetrical tapered portion connecting the terminal end and the main body portion, wherein the asymmetrical tapered portion positions a longitudinal axis of the terminal end portions to be offset from a longitudinal axis of said cylinder rod.

3. The steering cylinder mounting assembly according to claim 2, wherein said steering cylinder housing includes an upper surface, a lower surface, an outer face, and an inner face having the groove and protruding ribs formed therein and wherein the apertures are formed adjacent an edge of the lower surface.

4. The steering cylinder mounting assembly according to claim 3, wherein the lower surface is spaced apart from and parallel to the protruding rib members.

5. The steering cylinder mounting assembly according to claim 4, further comprising:

a link arm having a first end removably connected to the terminal end of said cylinder rod and a second end opposite the first end; and a clevis connected to the second end of said link arm, wherein rotation of said cylinder rod within said cylinder housing adjusts a height of said clevis with respect to said mounting bracket, thereby enabling connection of said steering cylinder assembly to a plurality of engine types.

6. The steering cylinder mounting assembly according to claim 1, wherein said mounting bracket is of a width to fit intermediate said ribs.

7. The steering cylinder mounting assembly according to claim 1, wherein said connecting members include a threaded bolt extending through aligned apertures in said cylinder housing and said mounting bracket.

8. The steering cylinder mounting assembly according to claim 1, wherein said ribs prevent shear stress from being applied to said connecting members.

9. The steering cylinder mounting assembly according to claim 7, wherein said ribs prevent shear stress from being applied to said threaded connecting bolts.

10. The steering cylinder mounting assembly according to claim 7, wherein each rib is of a length to prevent shearing of said connecting bolts.

11. The steering cylinder mounting assembly according to claim 1, wherein said asymmetrical taper is continuous with the body portion and the terminal end portion of said cylinder rod.

12. The steering cylinder mounting assembly according to claim 11, wherein the terminal end portion is rectangular.

13. The steering cylinder mounting assembly according to claim 5, wherein rotation of said cylinder rod varies a height of said terminal end and correspondingly varies a height of said link arm with respect to said mounting bracket.

14. A steering cylinder mounting assembly comprising:

a cylinder housing having a longitudinal opening formed therethrough, a groove formed along a longitudinal face of the cylinder housing, a protruding rib formed at opposite longitudinal ends of said cylinder housing and formed spaced apart from and parallel to the groove, and a plurality of apertures formed in a surface of said cylinder housing opposing the groove and transverse to a longitudinal axis of said cylinder housing;

a mounting bracket selectively connected with said cylinder housing, said mounting bracket positioned between said protruding ribs and including a tongue portion engageable with the groove of said cylinder housing, and a plurality of apertures formed therein transverse to a longitudinal axis of said cylinder housing;

connecting members aligned with the apertures of said cylinder housing and said mounting bracket for securing said cylinder housing to said mounting bracket; and a cylinder rod rotatably mounted within the longitudinal opening of said cylinder housing, said cylinder rod including a main body portion and opposing terminal end portions, each opposing terminal end portion having a reduced diameter relative to a diameter of the main body portion of said cylinder rod and an asymmetrical tapered portion connecting the terminal end and the main body portion, wherein the asymmetrical tapered portion offsets a longitudinal axis of the terminal end portions from a longitudinal axis of said cylinder rod.

15. The steering cylinder mounting assembly according to claim 14, wherein said steering cylinder housing includes an upper surface, a lower surface, an outer face, and an inner face having the groove and protruding ribs formed therein and wherein the apertures are formed adjacent an edge of the lower surface.

16. The steering cylinder mounting assembly according to claim 15, wherein the lower surface is spaced apart from and parallel to the protruding rib members.

17. The steering cylinder mounting assembly according to claim 16, further comprising:

a link arm having a first end removably connected to the terminal end of said cylinder rod and a second end opposite the first end; and a clevis connected to the second end of said link arm, wherein rotation of said cylinder rod within said cylinder housing adjusts a height of said clevis with respect to said mounting bracket, thereby enabling connection of said steering cylinder assembly to a plurality of engine types.

18. The steering cylinder mounting assembly according to claim 14, wherein said mounting bracket is of a width to fit intermediate said ribs.

19. The steering cylinder mounting assembly according to claim 14, wherein said connecting members include a threaded bolt extending through aligned apertures in said cylinder housing and said mounting bracket.

20. The steering cylinder mounting assembly according to claim 14, wherein said ribs prevent shear stress from being applied to said connecting members.

21. The steering cylinder mounting assembly according to claim 19, wherein said ribs prevent shear stress from being applied to said threaded connecting bolts.

22. The steering cylinder mounting assembly according to claim 19, wherein each rib is of a length to prevent shearing of said connecting bolts.

23. The steering cylinder mounting assembly according to claim 14, wherein said asymmetrical taper is continuous with the body portion and the terminal end portion of said cylinder rod.

24. The steering cylinder mounting assembly according to claim 23, wherein the terminal end portion is rectangular.

25. The steering cylinder mounting assembly according to claim 24, wherein rotation of said cylinder rod varies a height of said terminal end and correspondingly varies a height of said link arm with respect to said mounting bracket.

* * * * *